US010713949B2

(12) United States Patent
Nordbruch

(10) Patent No.: US 10,713,949 B2
(45) Date of Patent: Jul. 14, 2020

(54) METHOD AND APPARATUS FOR OPERATING A PARKING FACILITY CONTAINING A PLURALITY OF CONTROLLABLE INFRASTRUCTURE ELEMENTS

(71) Applicant: Robert Bosch GmbH, Stuttgart (DE)

(72) Inventor: Stefan Nordbruch, Kornwestheim (DE)

(73) Assignee: Robert Bosch GmbH, Stuttgart (DE)

( * ) Notice: Subject to any disclaimer, the term of this patent is extended or adjusted under 35 U.S.C. 154(b) by 184 days.

(21) Appl. No.: 15/773,487

(22) PCT Filed: Sep. 16, 2016

(86) PCT No.: PCT/EP2016/071959
§ 371 (c)(1),
(2) Date: May 3, 2018

(87) PCT Pub. No.: WO2017/084787
PCT Pub. Date: May 26, 2017

(65) Prior Publication Data

US 2018/0322786 A1 Nov. 8, 2018

(30) Foreign Application Priority Data

Nov. 20, 2015 (DE) ..... 10 2015 222 915

(51) Int. Cl.
*G08G 1/00* (2006.01)
*G08G 1/16* (2006.01)
*G08G 1/14* (2006.01)

(52) U.S. Cl.
CPC ..... *G08G 1/164* (2013.01); *G08G 1/146* (2013.01); *G08G 1/149* (2013.01)

(58) Field of Classification Search
CPC ..... G08G 1/164; G08G 1/146; G08G 1/149
(Continued)

(56) References Cited

U.S. PATENT DOCUMENTS 7,693,745 B1 * 4/2010 Pomerantz ..... G06Q 10/08 705/26.5
8,899,903 B1 * 12/2014 Saad ..... B65G 67/00 414/392

(Continued)

FOREIGN PATENT DOCUMENTS

DE 3823728 A1 1/1990
DE 102012222562 A1 6/2014

(Continued)

OTHER PUBLICATIONS

International Search Report dated Dec. 15, 2016, of the corresponding International Application PCT/EP2016/071959 filed Sep. 16, 2016.

*Primary Examiner* — Thomas G Black
*Assistant Examiner* — Wae L Louie
(74) *Attorney, Agent, or Firm* — Norton Rose Fulbright US LLP; Gerard Messina

(57) ABSTRACT

A method for operating a parking facility containing a plurality of controllable infrastructure elements, one or more of the infrastructure elements being controlled in such a way that traffic is able to be prevented from coming close to a vehicle moving without a driver within the parking facility. In addition, a corresponding apparatus, a corresponding parking facility, as well as a computer program, are also described.

6 Claims, 1 Drawing Sheet

(58) Field of Classification Search
USPC ..... 701/23
See application file for complete search history.

(56) References Cited

U.S. PATENT DOCUMENTS

| | | | | |
|---|---|---|---|---|
| 9,216,857 | B1 * | 12/2015 | Kalyan | G06Q 10/087 |
| 9,260,244 | B1 * | 2/2016 | Cohn | G05D 1/0297 |
| 9,545,852 | B2 * | 1/2017 | Streett | B64C 39/024 |
| 9,561,941 | B1 * | 2/2017 | Watts | B66F 9/063 |
| 9,671,791 | B1 * | 6/2017 | Paczan | B64C 39/024 |
| 10,222,798 | B1 * | 3/2019 | Brady | G05D 1/0278 |
| 2007/0293978 | A1 * | 12/2007 | Wurman | G05B 19/4189 700/213 |
| 2008/0199298 | A1 * | 8/2008 | Chilson | B60L 15/2036 414/809 |
| 2010/0183409 | A1 * | 7/2010 | Checketts | B62D 7/026 414/231 |
| 2015/0158599 | A1 * | 6/2015 | Sisko | A47G 29/141 244/114 R |
| 2015/0175276 | A1 * | 6/2015 | Koster | B64F 1/32 244/114 R |
| 2015/0185034 | A1 * | 7/2015 | Abhyanker | G01C 21/36 701/23 |
| 2015/0202770 | A1 * | 7/2015 | Patron | B25J 5/007 700/245 |
| 2015/0339928 | A1 * | 11/2015 | Ramanujam | G08G 1/202 701/23 |
| 2016/0129592 | A1 * | 5/2016 | Saboo | B25J 9/0084 700/248 |
| 2016/0266578 | A1 * | 9/2016 | Douglas | G05D 1/0231 |
| 2016/0282126 | A1 * | 9/2016 | Watts | G01C 21/206 |
| 2017/0166399 | A1 * | 6/2017 | Stubbs | B25J 9/0096 |
| 2018/0053141 | A1 * | 2/2018 | Shydo, Jr. | G05D 1/104 |
| 2019/0016384 | A1 * | 1/2019 | Carlson | G05D 1/0274 |

FOREIGN PATENT DOCUMENTS

| | | | |
|---|---|---|---|
| DE | 102014001836 | A1 | 8/2014 |
| DE | 202015104709 | U1 | 10/2015 |
| DE | 102014221770 | A1 | 4/2016 |
| DE | 102015202486 | A1 | 8/2016 |
| WO | 2006058445 | A1 | 6/2006 |
| WO | 2016066354 | A1 | 5/2016 |

* cited by examiner

METHOD AND APPARATUS FOR OPERATING A PARKING FACILITY CONTAINING A PLURALITY OF CONTROLLABLE INFRASTRUCTURE ELEMENTS

FIELD

The present invention relates to a method and an apparatus for operating a parking facility containing a plurality of controllable infrastructure elements. The present invention also relates to a parking facility for vehicles, as well as a computer program.

BACKGROUND INFORMATION

German Patent Application NO. DE 10 2012 222 562 A1 describes a system for managed parking areas, in order to transfer a vehicle from a starting position to a destination position.

In the case of fully automated (autonomous) so-called valet parking, a driver parks his vehicle at a drop-off location, for example, in front of a parking garage, and from there, the vehicle drives itself to a parking position/parking space and back again to the drop-off location.

Thus, in the case of fully automated valet parking, usually no driver is sitting in the vehicle itself. Such a vehicle may be referred to as a driverless moving vehicle. If further persons or further vehicles guided manually, thus, by a driver, are also present within the parking facility, what is referred to as mixed traffic may come about. Mixed traffic denotes traffic made up of manually guided vehicles and persons, respectively, as well as vehicles guided without a driver. That is, manually guided vehicles and pedestrians, for example, may thus be present in the course of the fully automated valet parking.

For example, in such mixed traffic, situations may arise which generally, among real people, can be controlled by hand signals, for instance. This is usually not possible in a situation between a manually guided vehicle and a vehicle guided without a driver. An example for such a situation is, e.g., a situation in which it is unclear which vehicle or which person has the right of way.

Consequently, problems may thus occur within the parking facility in the case of mixed traffic. Operation of the parking facility may therefore be disrupted.

SUMMARY

An object of the present invention is to providing an efficient way, based on which a parking facility containing a plurality of controllable infrastructure elements may be operated efficiently.

Advantageous developments of the present invention are described herein.

According to one aspect of the present invention, a method is provided for operating a parking facility containing a plurality of controllable infrastructure elements, one or more of the infrastructure elements being controlled in such a way that traffic may be prevented from coming close to a vehicle moving without a driver within the parking facility.

According to another aspect of the present invention, an apparatus is provided for operating a parking facility containing a plurality of controllable infrastructure elements, including a control device for controlling one or more of the infrastructure elements in such a way that traffic may be prevented from coming close to a vehicle moving without a driver within the parking facility.

According to a further aspect of the present invention, a parking facility for vehicles is provided, including a plurality of controllable infrastructure elements and the apparatus for operating a parking facility containing a plurality of controllable infrastructure elements.

According to another aspect of the present invention, a computer program is provided which includes program code for carrying out the method for operating a parking facility containing a plurality of controllable infrastructures elements, when the computer program is executed on a computer.

Thus, notably and among other things, the present invention includes the idea of controlling or driving the infrastructure elements of the parking facility in such a way that based on the control or driving, traffic may be prevented from coming close to a vehicle moving without a driver within the parking facility. In particular, this provides the technical advantage that the parking facility is able to be operated efficiently.

Traffic as defined in the present invention includes, in particular, persons and/or manually guided vehicles and/or further vehicles moving without a driver.

For example, a vehicle within the meaning of the present invention is a motor vehicle. A motor vehicle is, e.g., a passenger car (PC) or a truck (TRK). For instance, the motor vehicle is a two-wheeled motor vehicle, e.g., a motorcycle.

Traffic within the parking facility therefore denotes the persons and/or the manually guided vehicles and/or the further vehicles moving without a driver, which are present within the parking facility.

Specifically, a driverless moving vehicle denotes a vehicle which is driving autonomously, thus, independently, within the parking facility. A driverless moving vehicle especially denotes a vehicle which is operated by remote control. In particular, a driverless moving vehicle denotes a vehicle which, for example, is operated by remote control for one section and drives a further section autonomously.

In other words, in the case of a driverless moving vehicle, a driver thus no longer has to guide the vehicle.

A manually guided vehicle denotes a vehicle in which there is a driver for the purpose of guiding the vehicle. The driver thus guides the vehicle manually. During such a manual guidance of the vehicle, it may be provided, for example, that in so doing, the driver is assisted by one or more driver assistance systems. Nevertheless, the presence of the driver is absolutely necessary for the vehicle to drive or be guided within the parking facility.

In particular, the formulation "and . . . , respectively" includes the formulation "and/or."

A parking facility in terms of the present invention may be described as a parking area, and is used as parking for vehicles. Thus, in particular, the parking facility forms one cohesive area that has a plurality of parking spaces (in the case of a parking facility on private property) or parking stands (in the case of a parking facility on public property). According to one specific embodiment, the parking facility takes the form of an indoor parking lot. According to one specific embodiment, the parking facility takes the form of a parking garage.

A controllable infrastructure element for the purpose of the present invention denotes, in particular, an element or a device of the parking facility which is able to be controlled, thus, is controllable. So, for example, a supporting column of a parking garage is an infrastructure element of the parking facility, but is not a controllable infrastructure element. A supporting column cannot be controlled. On the other hand, an elevator installation of the parking garage is a controllable infrastructure element, for an elevator installation is able to be controlled, thus, is controllable.

In other words, a controllable infrastructure element thus denotes an infrastructure element by use of which it is possible to interact, for example, or which, for instance, is able to be actuated, e.g., may be actuated mechanically and/or electronically.

The plurality of controllable infrastructure elements includes at least one or more of the following controllable infrastructure elements: Elevator installation, light signaling system, barriers, doors, especially gates, lighting, loudspeakers.

According to one specific embodiment, the control of the one or more infrastructure elements includes that an elevator door of an elevator installation is not opened until the vehicle moving without a driver has driven past the elevator door.

Specifically, this yields the technical advantage that people who exit or step out from the elevator installation, or more precisely, from the elevator car can no longer cross paths with the driverless moving vehicle (this holds true analogously for vehicles that are transported by the elevator installation, except that they drive out and do not step out of the elevator car). In particular, these people can no longer come close to the vehicle moving without a driver, inasmuch as the driverless moving vehicle has already driven past the elevator door and therefore the elevator installation.

According to one specific embodiment, the elevator installation is a passenger-elevator installation. In another specific embodiment, the elevator installation is a vehicle-elevator installation. In other words, a passenger-elevator installation is thus designed to transport people. A vehicle-elevator installation is designed to transport one or more vehicles. The remarks made in connection with the people who want to step out of the elevator installation hold true analogously for a vehicle-elevator installation, out of which one or more vehicles want to drive. Here, as well, it is specifically provided that the elevator door is not opened until the driverless moving vehicle has driven past the elevator door.

According to a further specific embodiment, the control of the one or more infrastructure elements includes that a light signaling system is controlled in such a way that a signal generator of the light signaling system emits a stop signal in order to signal to the traffic that it is to stop.

In particular, this yields the technical advantage that it is signaled efficiently to the traffic that it should stop. Consequently, in advantageous manner, traffic may be prevented efficiently from continuing to approach the driverless moving vehicle.

According to a further specific embodiment, instead of or in addition to the light signaling system, an acoustic signaling system is provided which includes an acoustic signal generator. Namely, the control then includes that this acoustic signaling system is controlled in such a way that the acoustic signal generator of the acoustic signaling system emits an acoustic stop signal in order to signal to the traffic that it should come to a stop.

According to a further specific embodiment, the control of the one or more infrastructure elements includes that a barrier is closed.

In particular, this yields the technical advantage that traffic may be prevented efficiently from continuing to move.

According to another specific embodiment, the control of the one or more infrastructure elements includes that a door is closed.

In particular, this provides the technical advantage that the traffic may be prevented efficiently from progressing. Thus, for example, the traffic may no longer enter a predetermined area in which the driverless moving vehicle is driving.

According to one specific embodiment, the apparatus for operating a parking facility containing a plurality of controllable infrastructure elements is designed or equipped to carry out or implement the method for operating a parking facility containing a plurality of controllable infrastructure elements.

Technical functionalities of the apparatus are obtained analogously from corresponding technical functionalities of the method and vice versa.

According to one specific embodiment, a driving-environment sensor system is provided, the driving-environment sensor system including one or more driving-environment sensors that are distributed spatially within the parking facility. For example, a driving-environment sensor is one of the following driving-environment sensors: radar sensor, ultrasonic sensor, lidar sensor, infrared sensor, video sensor, laser sensor and magnetic sensor. That is, specifically, a driving environment within the parking facility is able to be or rather is sensed with the aid of the driving-environment sensor system. Based on the sensing of the driving environment, it is able to be or rather is determined, for example, where the traffic and/or the driverless moving vehicle is/are located within the parking facility.

According to one specific embodiment, the one or more infrastructure elements are then controlled appropriately based on the sensing of the driving environment.

For instance, this provides the technical advantage that a convergence may be prevented efficiently in so far as it is now known where the driverless moving vehicle and the traffic, respectively, are located. Thus, for example, no barriers which are very far away from the driverless moving vehicle have to be closed, since in the case of traffic which is likewise very far away from the driverless moving vehicle, as a rule, mixed traffic cannot occur.

The present invention is explained in greater detail below on the basis of preferred exemplary embodiments.

DETAILED DESCRIPTION OF EXAMPLE EMBODIMENTS

Figure 1:
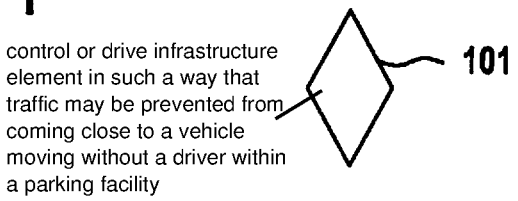
FIG. 1 shows a flowchart of a method for operating a parking facility containing a plurality of controllable infrastructure elements.

FIG. 1 shows a flowchart of a method for operating a parking facility containing a plurality of controllable infrastructure elements.

According to a step 101, one or more of the infrastructure elements is/are controlled or driven in such a way that traffic may be prevented from coming close to a vehicle moving without a driver within the parking facility.

For example, an elevator door of an elevator installation is not opened until the driverless moving vehicle has driven past the elevator door. For instance, it is provided here to track the driverless moving vehicle with the aid of a driving-environment sensor system. Only when it is determined, based on the tracking and/or the sensing of the driving environment, that the driverless moving vehicle has driven past the elevator door, is the elevator door opened.

For example, by suitable control of the light signaling system, a signal generator of the light signaling system emits a stop signal in order to signal to the traffic that it is to stop. Thus, for instance, it is possible to signal to a manually guided vehicle that it is to stop, in order to allow the driverless moving vehicle to drive past.

Figure 2:
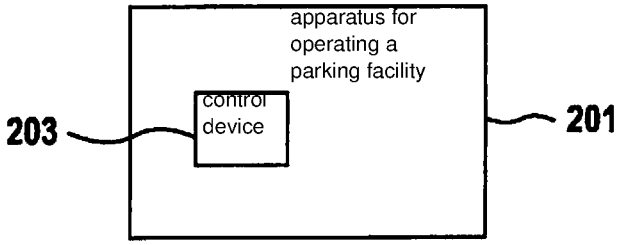
FIG. 2 shows an apparatus for operating a parking facility containing a plurality of controllable infrastructure elements.

FIG. 2 shows an apparatus 201 for operating a parking facility containing a plurality of controllable infrastructure elements.

Apparatus 201 includes a control device 203 for controlling one or more of the infrastructure elements in such a way that traffic may be prevented from coming close to a vehicle moving without a driver within the parking facility.

According to one specific embodiment, apparatus 201 includes a communication interface for communicating with at least one or more of the infrastructure elements. For instance, according to one specific embodiment, for the control, control device 203 thus transmits suitable control commands or control signals via the communication interface to the infrastructure elements. For example, with the aid of the communication interface, control device 203 transmits a control command to an elevator installation, so that it opens the elevator door in response to the control command. In this case, the control command is not transmitted to the elevator installation until, with the aid of a driving-environment sensor system, for instance, it is determined that the driverless moving vehicle has driven past the elevator door.

In other words, the communication interface is thus designed to communicate with the infrastructure elements via a communication network. For example, the communication network includes a wireless and/or wire-bound communication network. For instance, a wireless communication network includes a WLAN network and/or a cellular network. According to one specific embodiment, the wireless communication network includes a communication network according to the LoRa Standard. "LoRa" stands for "Low-Power Wide-Range Communication." Therefore, according to one specific embodiment, the communication network includes a LoRa communication network. For example, the wire-bound communication network is an Ethernet communication network.

In one specific embodiment, a communication via the communication network is or has been encoded.

Figure 3:
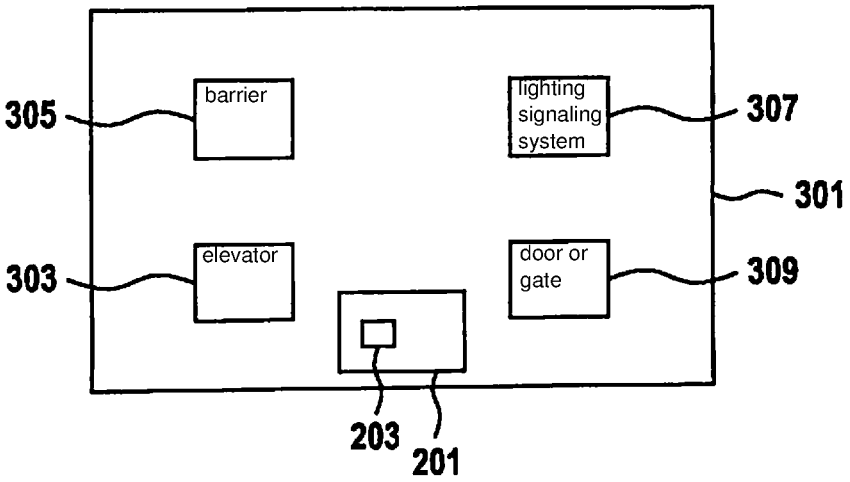
FIG. 3 shows a parking facility for vehicles.

FIG. 3 shows a parking facility 301 for vehicles.

Parking facility 301 contains a plurality of controllable infrastructure elements 303, 305, 307, 309. Parking facility 301 includes apparatus 201 of FIG. 2.

For instance, infrastructure element 303 is an elevator installation. Infrastructure element 305 is a barrier, for example. Infrastructure element 307 is a light signaling system, for example. Infrastructure element 309 is a door, for instance, especially a gate.

In other words, with the aid of control device 203, apparatus 201 controls this plurality of infrastructure elements 303, 305, 307, 309 in such a way that traffic located within the parking facility may be prevented from coming close to a vehicle moving without a driver, which is likewise driving within the parking facility.

Thus, notably and among other things, the invention includes the idea of providing an efficient technical concept by which problems, which may develop because of mixed traffic, may be reduced. The basic idea of the present invention may be seen especially in the fact that mixed traffic may be reduced in the vicinity of the vehicle(s) moving without a driver.

In general, a vehicle moving without a driver may be referred to as an AVP vehicle.

"AVP" stands for "automated valet parking" and may be described by automatic parking process. Such an AVP vehicle is designed specifically to carry out an automatic parking process. That is, the AVP vehicle is thus designed to drive without a driver from a drop-off position, at which the vehicle was parked by a driver of the vehicle, to a parking position in the parking facility and to park there. The AVP vehicle is designed to drive without a driver from this parking position to a pick-up position, where the driver is able to pick up his vehicle. For instance, the pick-up position is identical to the drop-off position. For example, these positions are separate from each other within the parking facility.

The prevention of mixed traffic, thus, in general, an approach of traffic to the driverless moving vehicle may be reduced or prevented particularly by preventing an access or proximity of manually guided vehicles and persons, thus people, to the driverless moving vehicle. For example, a parking-facility management or parking-facility administration system is provided, which manages operation of the parking facility. The parking-facility management system includes apparatus 201, for instance.

In particular, the prevention is implemented when the AVP vehicle(s) is/are on the move, thus, is/are moving without a driver within the parking facility. In the case of AVP vehicles which are still stationary, notably, it is provided that they don't set off in the first place.

Namely, the approach, especially the temporary approach, is prevented because the apparatus, in general the parking-facility management system, has access to the entire infrastructure, thus, access to the controllable infrastructure elements. Examples for such infrastructure elements are, for instance: light signaling systems (colloquially also called traffic lights), barriers, doors, especially gates, elevators (thus elevator installations).

As a consequence, for example, the parking-facility management system is able to prevent people or vehicles from crossing a travel path of the AVP vehicle too closely or coming too close to the vehicle. For instance, it is provided that an elevator door does not open until the AVP vehicle has driven past the elevator door.

What is claimed is:

1. A method for operating a parking facility containing a plurality of controllable infrastructure elements, the method comprising:

controlling at least one of the infrastructure elements so that in mixed traffic, a vehicle having a driver is prevented from operating in a same area as a driverless vehicle moving, which is without a driver, within the parking facility;

wherein the at least one of the infrastructure elements includes an elevator door of an elevator installation, and the controlling includes not opening the elevator door of the elevator installation until the vehicle moving without a driver has driven past the elevator door, and wherein the at least one infrastructure element includes a light signaling system, and the controlling includes controlling the light signaling system so that a signal generator of the light signaling system emits a stop signal to signal to the traffic that it is to stop, so as to prevent the vehicle having the driver from operating in the same area as the driverless vehicle moving, which is without the driver, within the parking facility.

2. The method as recited in claim 1, wherein the at least one infrastructure element includes a barrier, and the controlling includes closing the barrier.

3. The method as recited in claim 1, wherein the at least one infrastructure element includes a door, and the controlling includes closing the door.

4. An apparatus for operating a parking facility containing a plurality of controllable infrastructure elements, comprising:

a control device to control at least one of the infrastructure elements so that in mixed traffic, a vehicle having a driver is able to be prevented from operating in a same area as a driverless vehicle moving, which is without a driver, within the parking facility;

wherein the at least one of the infrastructure elements includes an elevator door of an elevator installation, and the controlling includes not opening the elevator door of the elevator installation until the vehicle moving without a driver has driven past the elevator door, and wherein the at least one infrastructure element includes a light signaling system, and the controlling includes controlling the light signaling system so that a signal generator of the light signaling system emits a stop signal to signal to the traffic that it is to stop, so as to prevent the vehicle having the driver from operating in the same area as the driverless vehicle moving, which is without the driver, within the parking facility.

5. A parking facility for vehicles, comprising:

a plurality of controllable infrastructure elements and an apparatus for operating the parking facility, the apparatus including a control device to control at least one of the infrastructure elements so that in mixed traffic, a vehicle having a driver is able to be prevented from operating in a same area as a driverless vehicle moving, which is without a driver, within the parking facility;

wherein the at least one of the infrastructure elements includes an elevator door of an elevator installation, and the controlling includes not opening the elevator door of the elevator installation until the vehicle moving without a driver has driven past the elevator door, and wherein the at least one infrastructure element includes a light signaling system, and the controlling includes controlling the light signaling system so that a signal generator of the light signaling system emits a stop signal to signal to the traffic that it is to stop, so as to prevent the vehicle having the driver from operating in the same area as the driverless vehicle moving, which is without the driver, within the parking facility.

6. A non-transitory machine-readable storage medium, on which is stored a computer program, comprising:

a program code arrangement having program code for operating a parking facility the parking facility containing a plurality of controllable infrastructure elements, by performing the following:

controlling, via a control device, at least one of the infrastructure elements so that in mixed traffic, a vehicle having a driver is prevented from operating in a same area as a driverless vehicle moving, which is without a driver, within the parking facility;

wherein the at least one of the infrastructure elements includes an elevator door of an elevator installation, and the controlling includes not opening the elevator door of the elevator installation until the vehicle moving without a driver has driven past the elevator door, and wherein the at least one infrastructure element includes a light signaling system, and the controlling includes controlling the light signaling system so that a signal generator of the light signaling system emits a stop signal to signal to the traffic that it is to stop, so as to prevent the vehicle having the driver from operating in the same area as the driverless vehicle moving, which is without the driver, within the parking facility.

* * * * *